US005282588A

United States Patent [19]

August

[11] Patent Number: 5,282,588

[45] Date of Patent: Feb. 1, 1994

[54] GAPPED FLAP FOR A MISSILE

[75] Inventor: Henry August, Chatsworth, Calif.

[73] Assignee: Hughes Aircraft Company, Los Angeles, Calif.

[21] Appl. No.: 903,249

[22] Filed: Jun. 22, 1992

[51] Int. Cl.[5] ..... F42B 10/14; F42B 10/62

[52] U.S. Cl. ..... 244/3.3; 244/3.27

[58] Field of Search ..... 244/3.3, 3.28, 3.27

[56] References Cited

U.S. PATENT DOCUMENTS

| | | | |
|---|---|---|---|
| H854 | 12/1990 | Madderra | 244/2.8 |
| 3,313,499 | 4/1967 | Öhman | 244/3.3 |
| 4,411,398 | 10/1983 | Wedertz et al. | 244/3.27 |
| 5,125,344 | 6/1992 | Kline et al. | 244/3.3 |

*Primary Examiner*—David H. Brown

*Attorney, Agent, or Firm*—Randall M. Heald; Charles D. Brown; Wanda Densow-Low

[57] ABSTRACT

A missile (20) comprises a missile body (22) and a plurality of (typically four) body flaps (28) located around the circumference of the missile body (22). Each body flap (28) is independently pivotable to an extended position wherein the body flap (28) is pivoted outwardly from a pivot axis along the leading edge (34) of the body flap (28). The forward edge (34) of the body flap (28) is displaced outwardly from the body (22) of the missile (20) by a distance no less than a boundary layer thickness of the body (22) of the missile (22) at the maximum operating speed and altitude of the missile (20), and preferably about the boundary layer thickness, which thickness typically is about 1-3 inches for a high-velocity missile.

17 Claims, 1 Drawing Sheet

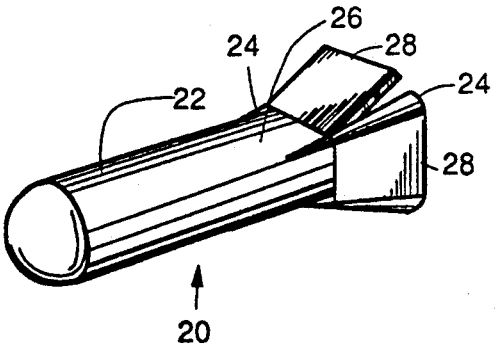
FIG. 1
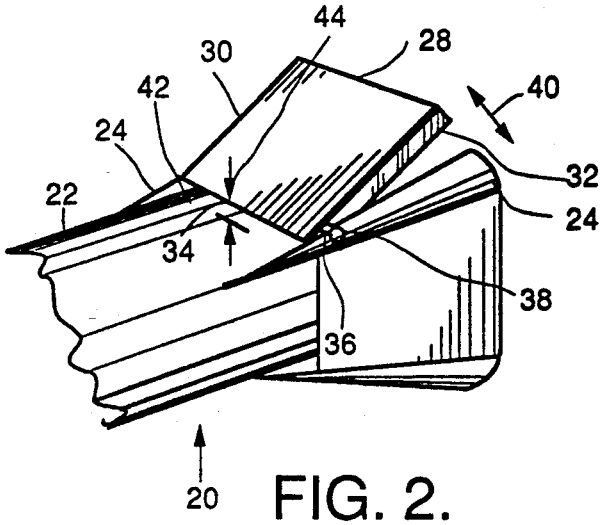
FIG. 2.
FIG. 3.
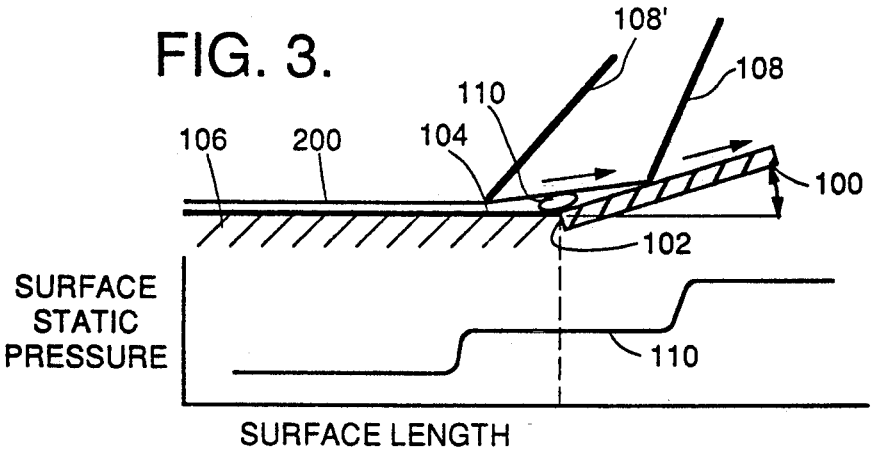
FIG. 4.
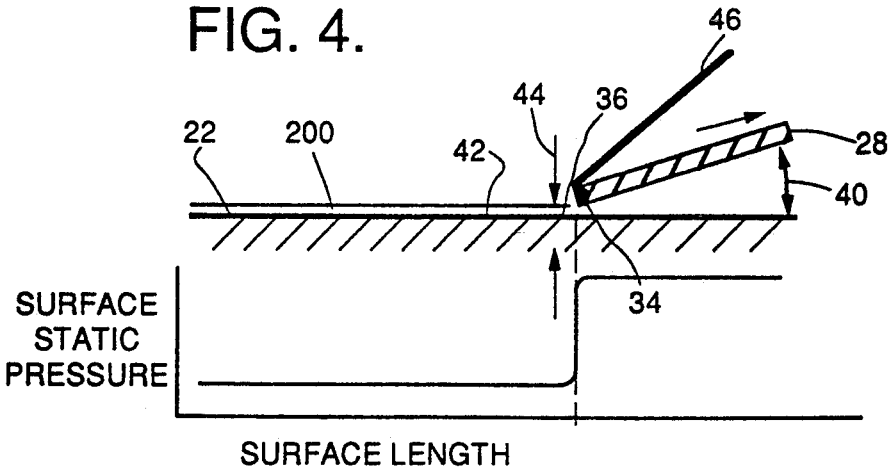

GAPPED FLAP FOR A MISSILE

BACKGROUND OF THE INVENTION

This invention relates to the control of a missile, and, more particularly, to a control surface positioned for improved effectiveness.

The trajectory of missiles that fly through the air can be controlled either by moving control surfaces into the air stream, pivoting the primary propulsion engine, pushing the nose of the missile sideways with thrusters, or a combination of these techniques. Movable control surfaces are preferred for many applications, because the are effective and well understood, and because their added weight is relatively small. The present invention is concerned with the control of missile flight with movable control surfaces.

Movable control surfaces may be provided on the wings of the missile, if any, or extending from the body of the missile. In the latter case, a trailing edge body flap typically is found on a wingless missile carried in an internal weapons bay of an aircraft. This type of missile relies primarily on the power of its engine rather than aerodynamic lift to maintain it aloft. There are typically four body flaps, symmetrically located 90 degrees apart around the tail of the missile. Each body flap is a panel that is pivotable outwardly from a position flush with the body of the missile to a position in which it extends into the air stream. The body flaps do not provide primary lift to the missile. Instead, the unbalanced aerodynamic effect of the extended flap is used to change the orientation of the missile and thence control its direction of flight. The flaps are used singly or in combination to attain the selected flight orientation.

It has been observed that such controllable body flaps often experience reduced effectiveness as the speed of the missile increases into the high subsonic, transonic, and supersonic speed ranges, and at high altitudes. The result is reduced sensitivity of the missile to its control commands, and the need to use larger flaps to maintain a required level of sensitivity at high speeds and altitudes.

There is a need for an improved control approach for missiles that reduces the degradation of control effectiveness. The present invention fulfills this need, and further provides related advantages.

SUMMARY OF THE INVENTION

The present invention provides a modified design for a body flap that reduces its loss of effectiveness at high speeds and altitudes. The body flap of the invention reduces flow separation induced by boundary layer effects that increase with increasing speed and altitude of the missile. The retention of effectiveness of the body flap permits the body flap to be retained at a small size rather than enlarged to provide sufficient control effect at high speeds and altitudes. A further result is that the size of the missile can be smaller than would be the case for a less-effective body flap, so that more missiles can be packed into the available space of a weapons bay.

In accordance with the invention, a missile comprises a missile body, and a flap movable to an extended position wherein the flap is angled outwardly from the missile body. The forward edge of the flap is displaced outwardly from the body of the missile by a distance of no less than a boundary layer thickness of the body of the missile (and preferably by about the boundary layer thickness) at the maximum operating speed and altitude of the missile, when the flap is extended outwardly. There is usually a plurality, typically four, of the body flaps arranged symmetrically on supports around the circumference of the body of the missile. Each flap can pivot outwardly on a pivot extending between the adjacent supports, the pivot running through the flap near its leading edge.

The conventional approach in the design of a body flap is to make the leading edge of the flap flush with the body of the missile, both when the flap is stowed nearly parallel to the body of the missile and when it is extended into the airstream. This design is thought to reduce drag of the body flap and thence to improve the overall performance of the missile.

The approach of the present invention instead relies upon an analysis of the air flow adjacent the missile body and body flap. The analysis reveals that the interaction of the disrupted flow of the boundary layer adjacent to the surface of the missile body can interact with the shock wave produced by the flap surface to produce a flow separation that moves forward progressively with increasing speed and altitude. This flow separation produces a reduced pressure rise at the forward region of the body flap and reduces its effectiveness.

The present design for the body flap raises the leading edge of the body flap above the boundary layer adjacent to the skin of the body of the missile. The boundary layer flow is no longer separated by the flap (although there can be a slight local disturbance by flap supports and other structure). The avoidance of separation of the boundary layer in turn prevents an interaction between a separated flow and the shock wave of the body flap. Instead, the shock wave of the flap propagates from its leading edge, producing smooth air flow over the body of the missile and a high pressure over the entire body flap. Body flap performance is not lost at high speeds and altitudes.

The leading edge of the body flap is raised by an amount that places it above the boundary layer of the body of the missile, when the body flap is extended outwardly. The thickness of the boundary layer depends upon the speed and the altitude of operation of the missile, the length of the missile, and the surface finish of the missile body. However, in many cases of practical interest, the boundary layer is about 1-3 inches thick, so that the leading edge of the body flap must be nominally displaced by that distance from the body of the missile. The performance requirements of a particular missile will in turn determine the exact values of the boundary layer. Once the exact performance requirements are known, the boundary layer and thence the leading edge displacement can be determined from conventional calculations or measurements.

Thus, in this case, a missile comprises a missile body and four flaps located around the circumference of the missile body. Each flap is independently pivotable from a position substantially parallel to the body of the missile to an extended position wherein the flap is pivoted outwardly from a pivot axis along the forward edge of the flap. The forward edge of each flap is displaced outwardly from the body of the missile by a distance of about 1-3 inches, when the flap is pivoted outwardly. The flaps are supported on four supports extending outwardly at locations 90 degrees apart around the circumference of the missile body, each support providing a pivot point for the adjacent ends of two circumferentially adjacent flaps.

This invention provides an improved design for a missile whose primary orientation control is based on the use of body flaps. The invention improves the effectiveness of the body flap, in turn permitting the body flap to be made smaller while retaining the controllability of the missile. Other features and advantages of the invention will be apparent from the following more detailed description of the invention, taken in conjunction with the accompanying drawings, which illustrate, by way of example, the principles of the invention.

BRIEF DESCRIPTION OF THE DRAWINGS

FIG. 1 is perspective view of a missile guided by movable body flaps;

FIG. 2 is a detail of FIG. 1, illustrating a gapped body flap according to the invention, with portions broken away to show the activator mechanism;

FIG. 3 is a schematic elevational view of the aerodynamic flow adjacent a conventional body flap and with a superimposed graph of pressure; and FIG. 4 is a schematic elevational view like that of FIG. 3, adjacent the gapped body flap of the invention and with a superimposed graph of pressure.

DETAILED DESCRIPTION OF THE INVENTION

FIG. 1 depicts a missile 20 having a missile body 22 and four body flap supports 24 near a tail 26 of the missile. There is an engine (not shown) in the tail of the missile, and various sensors and control electronics (not shown) within the interior of the missile. The body flap supports 24 are spaced around the circumference of the missile body 22 at 90 degree intervals in the preferred embodiment.

Referring to FIG. 2, a body flap 28 is a panel having a generally flat upper surface 30, oppositely disposed lateral surfaces 32, and a leading edge 34. In the preferred approach, as illustrated, there are four body flaps 28, extending between the adjacent pairs of supports 24. The body flap 28 is supported by a pair of pivots 36 at the lateral surfaces 32, near the leading edge 34. For each body flap 28, there is at least one actuator 38 located inside the support 24 and acting through the pivot 36 to controllably pivot the body flap 28 outwardly, as indicated by the arrow 40.

A key feature of the present invention is that the leading edge 34 of the body flap 28 is displaced laterally outwardly from a surface 42 of the body 22 of the missile 20 by a gap spacing, indicated at numeral 44, when the body flap 28 is pivoted outwardly from the body of the missile as shown in FIG. 2.

The approach of the present invention, illustrated in FIG. 4, may be contrasted with the prior approach, illustrated in FIG. 3. In the prior approach, a body flap 100 is pivotably supported from supports, as in the present approach. However, a leading edge 102 of the body flap 100 is substantially flush with a surface 104 of the body 106 of a missile. That is, there is no substantial gap comparable to the gap 44 of FIGS. 2 and 4.

The advantage of a gap between the leading edge 34 of the body flap 28 of the invention may be understood from the aerodynamic characteristics of a missile. However, this brief explanation is not intended to be complete or comprehensive, and the invention should not be limited or otherwise interpreted in light of this explanation.

There is a boundary layer, indicated as numeral 200, at the surface of an object that moves through the air at a rapid velocity. The boundary layer is a transitional region adjacent the surface of the object, wherein the air velocity changes from zero at the very surface of the object, to the gross air stream velocity distant from the object. The thickness of the boundary layer 200 depends upon many factors, including the velocity of the object, the density of the air (and therefore the altitude), and the surface finish of the body of the missile. With these factors a constant, the thickness of the boundary layer 200 will be a constant.

When a portion of the object is extended into the air stream, as for example the body flap 100 of the prior approach, there is a shock front 108 that locates near the mid-chord of the body flap 100. A boundary layer separation 110 is a region of turbulence just forward of the leading edge 102, produced by the adverse pressure gradient imposed by the shock front upon the boundary layer flow as a result of the deflected body flap 100. A second shock front 108' propagates from the front of the boundary layer separation 110. As shown in the graph superimposed onto FIG. 3, there is a reduction in air pressure in the boundary layer separation region 110 between the two shock fronts 108 and 108' that leads to a loss of effectiveness of the body flap 100 in the region where the boundary layer separation 110 overlaps the body flap 100. Consequently, the portion of the body flap 100 contacting the boundary layer separation 110 is rendered less effective, so that the effective control area of the body flap is reduced. Thus, a body flap according to the prior approach must be designed to be larger than would otherwise be the case in order to account for the reduced effectiveness of a portion of its area resulting from this effect.

As shown in FIG. 4, the body flap 28 of the invention is supported on its pivot 36 so that its leading edge 34 is separated from the surface 42 of the body 22 by a gap 44 that is at least as great as the boundary layer 200. As a result, the boundary layer flow is not disturbed, there is no boundary layer separation, and a shock front 46 of the extended body flap 28 does not move forward past the leading edge 34 of the body flap 28. In most instances, the shock front 46 propagates from the leading edge 34 of the body flap 28. The superimposed graph of FIG. 4 illustrates the absence of a region of reduced pressure corresponding to the boundary layer separation 110 of FIG. 3.

As indicated, this discussion of the avoidance of the boundary layer separation effect is not intended to be comprehensive. However, it does illustrate the presence of the effect for a structure using a conventional body flap 100, and its absence for the gapped body flap 28 of the present invention. Avoidance of the boundary layer separation effect allows the gapped body flap 28 to retain its full effectiveness as a control surface to higher velocities and altitudes than possible for a conventional body flap 100. Compared on the basis of equal aerodynamic control effectiveness, the body flap 28 can therefore be made smaller than the body flap 100, reducing the size of the missile.

The dimension of the gap 44 between the leading edge 34 of the body flap 28 and the surface 42 of the body 22 is preferably about the thickness of the boundary layer 200. The thickness of the boundary layer 200 will depend upon specifics of missile design and performance, and is readily calculated for various missile types and missions. See, for example, H. Schlichting, "Boundary Layer Theory", Pergamon Press, 1955. In a typical case of a missile having a smooth skin of steel and designed to fly up to about Mach 3, the thickness of the boundary layer is about 1-3 inches.

More generally, the dimension 44 of the gap may be determined first by calculating the flight Reynolds number Re as determined by the nominal airspeed U, the missile body length L, and the kinematic viscosity of air KV, which depends upon altitude, as $$Re=UL/KV,$$

The boundary layer thickness is described as a function of Reynolds number in publications such as Schlichting, but is typically about one percent of the body length of the missile. The dimension 44 of the gap is preferably about that of the boundary layer thickness. A missile typically flies at a range of speeds and altitudes during a mission. The gap dimension is selected for the maximum boundary layer dimension estimated for a flight condition for a missile. For thinner boundary layer dimensions that might be encountered during the course of a mission, improved control effectiveness is also achieved.

Although a particular embodiment of the invention has been described in detail for purposes of illustration, various modifications may be made without departing from the spirit and scope of the invention. Accordingly, the invention is not to be limited except as by the appended claims.

What is claimed is:

1. A missile operable over a range of flight speeds and altitudes, comprising:

a missile body; and a flap movable to an extended position wherein the flap is angled outwardly from the missile body, the forward edge of the flap being displaced outwardly from the body of the missile by a distance no less than a maximum boundary layer thickness of the body of the missile experienced for the range of flight speeds and altitudes over which the missile is operable, when the flap is extended outwardly.

2. The missile of claim 1, wherein the forward edge of the flap is displaced outwardly from the body of the missile by a distance of about a boundary layer thickness of the body of the missile.

3. The missile of claim 1, further including a support at each side of the flap, the supports extending outwardly from the missile body.

4. The missile of claim 1, wherein the flap is a substantially flat panel.

5. The missile of claim 1, wherein the forward edge of the flap is displaced outwardly from the body of the missile by a distance of at least about 1 to about 3 inches.

6. The missile of claim 1, further including a pivot axis about which the flap pivots, the pivot axis being located adjacent the forward edge of the flap.

7. The missile of claim 1, wherein the distance by which the flap is displaced outwardly from the body of the missile is about one percent of the length of the missile.

8. The missile of claim 1, further including a plurality of additional flaps located around the circumference of the missile body, each flap and additional flap being independently pivotable from a position substantially parallel to the body of the missile to an extended position wherein the flap is pivoted outwardly from a pivot axis adjacent a forward edge of the flap.

9. The missile of claim 8, wherein there are a total of four flaps located around the circumference of the missile body.

10. A missile, comprising:

a missile body; and a plurality of flaps located around the circumference of the missile body, each flap being independently pivotable from a position substantially parallel to the body of the missile to an extended position wherein the flap is pivoted outwardly from a pivot axis adjacent a forward edge of the flap, the forward edge of the flap being displaced outwardly from the body of the missile by a distance no less than a boundary layer thickness of the body of the missile at the maximum operating speed and altitude of the missile, when the flap is pivoted outwardly.

11. The missile of claim 10, wherein the forward edge of the flap is displaced outwardly from the body of the missile by a distance of about a boundary layer thickness of the body of the missile.

12. The missile of claim 10, further including a support at each side of each flap, the supports extending outwardly from the missile body.

13. The missile of claim 10, wherein each flap is a substantially flat panel.

14. The missile of claim 10, wherein the forward edge of each flap is displaced outwardly from the body of the missile by a distance of at least about 1 to about 3 inches.

15. The missile of claim 10, wherein there are four flaps.

16. The missile of claim 10, wherein the distance by which the flap is displaced outwardly from the body of the missile is about one percent of the length of the missile.

17. A missile, comprising:

a missile body;

four flaps located around the circumference of the missile body, each flap being independently pivotable from a position substantially parallel to the body of the missile to an extended position wherein the flap is pivoted outwardly from a pivot axis along the forward edge of the flap, the forward edge of the flap being displaced outwardly from the body of the missile by a distance of from about 1 to about 3 inches, when the flap is pivoted outwardly; and four supports extending outwardly at locations 90 degrees apart around the circumference of the missile body, each support providing a pivot point for an end of two circumferentially adjacent flaps.

* * * * *